US006997429B2

(12) United States Patent
Meinrad

(10) Patent No.: US 6,997,429 B2
(45) Date of Patent: Feb. 14, 2006

(54) EXTERIOR MOLD

(75) Inventor: Hirlinger Meinrad, Burladingen-Melchingen (DE)

(73) Assignee: Baumgärtner GmbH Maschinenfabrik, Blaubeuren (DE)

( * ) Notice: Subject to any disclaimer, the term of this patent is extended or adjusted under 35 U.S.C. 154(b) by 240 days.

(21) Appl. No.: 10/220,812

(22) PCT Filed: Mar. 5, 2001

(86) PCT No.: PCT/EP01/02469

§ 371 (c)(1),
(2), (4) Date: Jan. 15, 2003

(87) PCT Pub. No.: WO01/66326

PCT Pub. Date: Sep. 13, 2001

(65) Prior Publication Data

US 2003/0164438 A1 Sep. 4, 2003

(30) Foreign Application Priority Data

Mar. 6, 2000 (DE) ..... 100 10 917

(51) Int. Cl.
*B28B 7/00* (2006.01)

(52) U.S. Cl. ..... 249/164; 249/48; 249/170

(58) Field of Classification Search ..... 249/48, 249/51, 57, 160, 164, 170
See application file for complete search history.

(56) References Cited

U.S. PATENT DOCUMENTS 1,445,907 A * 2/1923 Novy ..... 249/49
3,768,954 A * 10/1973 Marsh et al. ..... 425/451
3,785,607 A * 1/1974 Worker et al. ..... 249/48
4,178,338 A 12/1979 Bondpers et al.

FOREIGN PATENT DOCUMENTS

| | | |
|---|---|---|
| GB | 675 297 | 7/1952 |
| JP | 57 011015 | 1/1992 |

* cited by examiner

*Primary Examiner*—Donald Heckenberg
(74) *Attorney, Agent, or Firm*—Rothell Figg Ernst & Manbeck

(57) ABSTRACT

A securing device comprising at least one latch (22) and at least one latch mating-element (26) are used on two mutually displaceable mold-casing segments (14, 16) to close or open a mold casing (10) used in manufacturing molded bodies, in particular concrete pipes, said device securing the mold casing (10) in a position of manufacture. The latch (22) is displaceable by means of a drive unit (24) between a locked position wherein it locks up with a latch mating-element (26) and an unlocked position wherein no locking takes place between the latch (22) and the latch mating-element (26). In the invention, the drive unit (24) can be adjusted due to relative motions between the mold casing on one hand and its manufacturing environment on the other as determined by the manufacturing procedures between a ready-to-unlock position corresponding to the locked position of the latch (22) and a ready-to-lock position corresponding to the locked position.

17 Claims, 1 Drawing Sheet

EXTERIOR MOLD

This application is a 35 USC 371 National Phase Entry Application from PCT/EP01/02469, filed Mar. 5, 2001, and designating the U.S.

BACKGROUND OF THE INVENTION (1) Field of the Invention

The invention relates to a mold casing for the manufacture, i.e. production of molded bodies, in particular concrete pipes, said casing being readied for the manufacture of said bodies by being moved into a closed manufacturing position and being opened, for purposes of releasing the finished molded bodies, from said manufacturing position, two mutually displaceable mold casing segments opening and closing said mold casing by means of a securing device securing the mold casing in its manufacturing position, said securing device moreover including at least one latch mounted on one of said mold casing segments, further a latch mating-element which is mounted on the particular other mold casing segment, the minimum of one latch being displaceable by means of a drive element between a locked position corresponding to the mold casing manufacturing position wherein it latches onto an associated latch mating-element, and an unlocked position wherein the locking engagement is eliminated.

(2) Description of Related Art

Such mold casings are used in particular to manufacture reinforced or unreinforced concrete pipes that illustratively are used in waste water pipe lines. To manufacture a concrete pipe the mold casing is deposited in its closed state, wherein illustratively it may exhibit a substantially cylindrical geometry, onto a manufacturing table of a production machine such as is known for instance from the brochure "SOUVERAEN, Symbiosis of Experience and Inventiveness" issue denoted by W&P-JB-LeR-VN1-4/96.2.D by Baumgärtner GmbH Maschinenfabrik. When in the production machine, the closed mold casing is filled with concrete which thereupon is compacted by a compression tool moving inside the mold casing and along its longitudinal axis against the inner walls of said casing. It is also known to make concrete pipes by filling concrete into a mold cavity between the mold casing and a mold core and then to compact said concrete by vibrations induced by a shaking tool.

In both cases the mold casing containing the finished concrete pipe which as yet has not cured shall be removed from the production machine and be moved to a storage site and left there for curing. After the mold casing has been opened to facilitate releasing, this casing is removed from the concrete pipe. On account of the size and weight of the mold casings, their transportation into and out of the production machine as well as in the manufacturing hall in general requires using cranes, fork lifts and the like.

The most common mold casings regardless of the particular kind of manufacture are both the "spring mold casings" and the "folding mold casings".

Within the scope of the present specification, the expression "spring mold casing" denotes a mold casing exhibiting a substantially continuous circumferential mold wall that is interrupted only by a slot running through the longitudinal end faces of this casing. By means of the securing device mounted on both mold casing segments adjoining the slot, the mold casing may be spread apart to facilitate releasing and it may be constricted again in preparation for the manufacture of the next concrete pipe. In the light of the above discussion, "expansion" and "constriction" with respect to a spring mold casing correspond to the above cited "opening" and "closing" of the mold casing. It must be borne in mind in this regard that expanding the mold casing does not mandatorily entail that the mold cavity thereby shall have been made accessible from the outside through the slot. Instead said slot also may be closed by overlapping mutually adjoining mold casing segments.

On the other hand and within the scope of the present invention, a "folding mold casing" denotes a mold casing comprising at least two mold casing segments articulating on each other in pivoting manner. Illustratively these may be two substantially semi-cylindrical mold casing segments. However the mold casing of the invention also may consist of a larger number of mold casing segments, for instance three, where two quarter-circle mold-casing segments are linked in folding manner to a semi-circular mold casing segment and may be interconnected by the securing device. In this design the mutually linked mold casing segments are pivoted away from each other for the "opening" function and they shall be pivoted again toward each other for the "closing" function and thereupon be secured by the securing device.

Compared to the spring mold casings, the folding mold casings offer the advantage of less stressing the manufacturing scene. Spring mold casings require in particular to be removed "at the head" for the release function, that is, from above, from the finished concrete pipe, and this operation assumes an appropriate lift system as well as appropriate height of the manufacturing hall. Folding mold casings on the other hand may be removed in simple manner laterally from the finished concrete pipe. Moreover "at the head" releasing also is more time-consuming because the mold casing must move at least twice through a path corresponding to the length of the pipe.

In all modes of manufacturing and mold casing designs cited above, the complex operation of the securing device shall be a drawback. Conventionally the minimum of one latch shall be adjusted manually, electrically, hydraulically or pneumatically between its locked and unlocked positions. This adjustment requires in-house personnel made available for that purpose or it must be carried out by labor entrusted with inserting the mold casing into the production machine, its operation and the subsequent mold casing removal from said machine. As regards electrical, hydraulic or pneumatic adjustment, appropriate power units and supply hookups for them must be made available. Moreover valuable operating time is lost by connecting and disconnecting the power units and by operating them. In summary, operating the securing device entails considerable expenditure with respect to machinery and/or personnel and/or time, such a drawback being especially disadvantageous in the mass production of concrete pipes.

BRIEF SUMMARY OF THE INVENTION

Accordingly the objective of the present invention is to create a mold casing of which the securing device may be operated at lesser cost.

This problem is solved in the invention by a mold casing of the initially cited kind wherein, on account of the relative motions entailed by the production process between the mold casing on one hand and its manufacturing environment on the other hand, the drive unit may be moved between a ready-to-unlock position corresponding to the latch's locked position and a ready-to-lock position corresponding to its unlocked position. In this manner and for instance after the mold casing was inserted into the production machine, said casing's operating unit may be moved automatically into the locked mode by means of the machine table lowered onto this casing and when the mold casing is deposited on a hall floor or the like, said operating unit shall be automatically moved into its unlocked mode.

This feature is elucidated below in relation to an especially simple embodiment whereby the ready-to-unlock drive unit projects beyond a first, illustrative the lower end face of the mold casing and in its ready-to-lock position projects beyond a second, for instance the upper, end face of the mold casing:

After a production machine stage has ended—during which the minimum of one latch of the securing device was in its locked position and the drive unit therefore was projecting beyond the mold casing's lower end face—the mold casing shall be removed from the production machine for instance using a fork lift and it shall be deposited at an appropriate site, typically on the floor of a manufacturing hall. When being deposited the mold casing first comes to rest on the floor by the downward projecting drive unit, the weight of the mold casing and of the concrete pipe it contains forcing said unit upward relative to the mold casing until the entire mold casing rests by its lower end face on the floor. Accordingly the drive unit shall be forced out of its unlocked position when the mold casing is deposited on the ground and the associated minimum of one latch shall be automatically displaced from its locked position into the unlocked one. Contrary to the case of the mold casings of the state of the art, special operational steps will not be required in the case of the invention. After the mold casing has been opened, it is easily removed from the concrete pipe.

Provided the drive unit be situated in its ready-to-unlock position in a region between the first and the second end faces, however near the first one, and provided it be situated in its ready-to-lock position in a region between the first and the second end faces, however near the second one, and preferably in each case at a predetermined and non-vanishing spacing from the first and second end faces resp., then this design shall preclude in simple manner the danger of warping the drive unit when opening or closing the mold casing due to being dragged along the floor or the like.

In order to insert the mold casing of the invention into the production machine when manufacturing a further concrete pipe, no more is required than merely closing the mold casing in conventional manner. The minimum of one latch however initially remains in its unlocked position, whereby the drive unit assumes its ready-to-lock position wherein it projects beyond the upper end face of the mold casing. The mold casing now being closed but not yet secured again is inserted using a fork lift into the production machine. As soon as said machine starts operating, a machine table holding the supply of concrete descends until resting on the upper end face of the mold casing. As a result and as regards the mold casing of the invention, its drive unit projecting upward when in its ready-to-lock position and heretofore in its unlocked position shall then be displaced into the locked position. In this manner the mold casing of the invention also shall be automatically secured by means of its securing device on account of the descent of said machine table.

It follows from the above description of the drive unit and from the elucidation of its two positions of readiness that basically said drive unit may be implemented in a number of designs allowing converting its displacement from one position of readiness to the other into a corresponding displacement of the minimum of one latch. In an especially simple and economical embodiment, said drive unit includes a drive rod preferably displaceable in the longitudinal direction of the mold casing and preferably being longer than the mold casing.

A versatile development of the present invention provides that the drive rod comprises at least at one end a longitudinally adjustable length element, for instance a bolt screwed at least partly into or onto the drive rod. In this manner the length of the rod may be matched to the parameters determining its expulsion from a readiness position. For instance in the event of a very uneven floor where the mold casing of the invention must be deposited, it may be desirable to lengthen the drive rod by screwing outward a bolt fitted at the rod's lower end. In corresponding manner it may be highly desirable to lengthen the drive rod by screwing an opposite bolt outward where the machine table per se cannot be fully lowered.

Even though the invention was discussed in relation to a drive unit or drive rod, each of them in one of its two readiness positions projecting from its particular end face of the mold casing, it should be borne in mind that such is not mandatorily the only case. Illustratively the particular drive unit or drive rod which does not project above the particular end face may be forced out of its associated readiness position by means of a cam affixed to the machine table, the hall floor or the like. Alternatively or in addition, such a control cam also may be displaceably mounted on the mold casing. In the latter case the control cam, while being designed as a part which is independent of the drive rod, nevertheless may be considered being included in the drive unit.

The above discussed embodiment already shows that, following the removal of the mold casing of the invention from the production machine, the drive unit of the mold casing shall be automatically moved from the ready-to-be unlocked position wherein it projects beyond the lower mold casing end face into the direction of the ready-to-be locked position as the mold casing is being deposited on the ground. When the mold casing is inserted into the production machine, it shall be in the ready-to-be locked position wherein it projects above the upper end face of the mold casing and from which it shall be displaced for instance by the descending machine table in the direction of the ready-to-be unlocked position. In order to assure that the drive unit when subjected to such a constrained motion also shall immediately and reliably assume the other readiness position, a beyond-the-dead-point mechanism may be used which shall bias the drive unit as a function of its position in the direction of one of the two readiness positions. In this manner the drive unit is reliably prevented from remaining in an intermediate position wherein it would neither be loaded by the deposition of the mold casing on the ground nor by the machine table descending into the production machine and then would have to be moved first manually into a readiness position. Such beyond-the-dead-point mechanisms are known in the state of the art and therefore need not be discussed further herein.

When such a beyond-the dead-point mechanism is associated with the above drive rod, then this rod may be just as long as, or even shorter than, the mold casing even when it is not cooperating with a control cam. In that case the beyond-the-dead-point mechanism by itself must assure that the displacement of the drive rod out of one of its two readiness positions shall automatically entail that it will assume its particular alternative position of readiness.

In a further advantageous design of the present invention, the minimum of one drive unit is in the form of a latch that pivots when the drive unit is actuated and of a peg that can be engaged at its rear by the pivoting latch during said pivoting motion. The locked position of the latch in that case shall correspond to that position wherein the latch engages the peg at its rear whereas the unlocked position shall correspond to that position wherein the pivotable latch was pivoted out of the vicinity of said peg. Such pivotable latches have been found practical to secure mold casings against unintended opening, especially in the presence of high loads which are applied in the production machine on the mold casing. In principle however other kinds of latches may be used, for instance hook-shaped sliding latches which upon actuation of the drive element shall be displaced substantially rectilinearly between the locked position wherein they engage the peg from the rear and the unlocked position wherein they are far from said peg.

Moreover the latch and/or the latch mating element may be fitted with tapered surfaces. This design steps attains the goal that the mold casing segments interconnected by the securing device shall be secured not only against accidental opening but furthermore shall also be tightened to each other, thereby assuring good sealing of the mold casing against leakage of the d material being molded, for instance concrete. In order to make adjustable the tension by means of which the minimum of one latch in its locked position cooperates with the minimum of one latch mating element, the invention further proposes fitting the latch and/or the latch mating element with a mechanism adjusting the tension between latch and latch mating element in the locked position. When the latch is designed to be pivoting, this feature may be implemented for instance in that the peg eccentrically rests on an affixation shaft mounted on the mold casing.

For reasons of safety, at least one latch of the securing device may be fitted with a grip portion for manual actuation. In case part of the securing device should jam, such a grip portion allows manually acting on this securing device, where called for using tools such as plug-on pipe, to open or close it. It is understood that such a grip portion also may be mounted on the drive element provided there be appropriate mechanical strength.

Because several latches, in particular pivoting ones, are used in mold casings, in principle at least one drive element might be assigned to each latch. Accordingly as regards the mold casing of the invention, it might be fitted at each of various sites along its circumference with one drive rod "switching" one latch. Preferably however several latches, in particular all of them, shall be actuated by one common drive element. This goal might be attained for instance by configuring several latches one above the other as seen on an upright mold casing that are connected by one drive rod.

Furthermore the mold casing of the invention also is applicable in parallel production, that is when, in one operational step, a plurality of mold casings shall be simultaneously filled with a molding material, for instance concrete, from the same machine table.

BRIEF DESCRIPTION OF THE SEVERAL VIEWS OF THE DRAWINGS

The invention is elucidated below in relation to a preferred embodiment and the attached drawings.

DETAILED DESCRIPTION OF THE INVENTION

Figure 1:
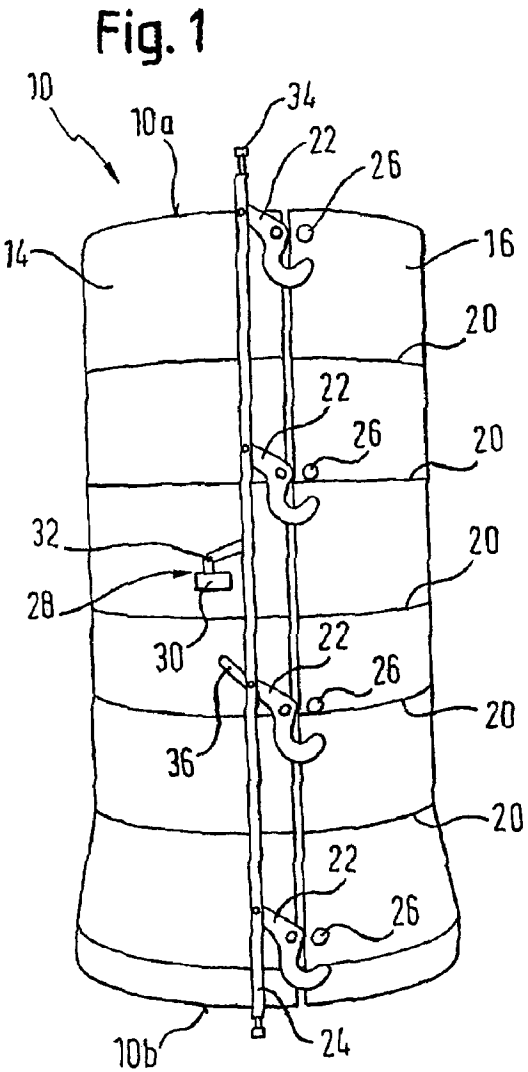
FIG. 1 is a front view of an upright and closed mold casing of the invention of which the drive rod is in the ready-to-lock position.
Figure 2:
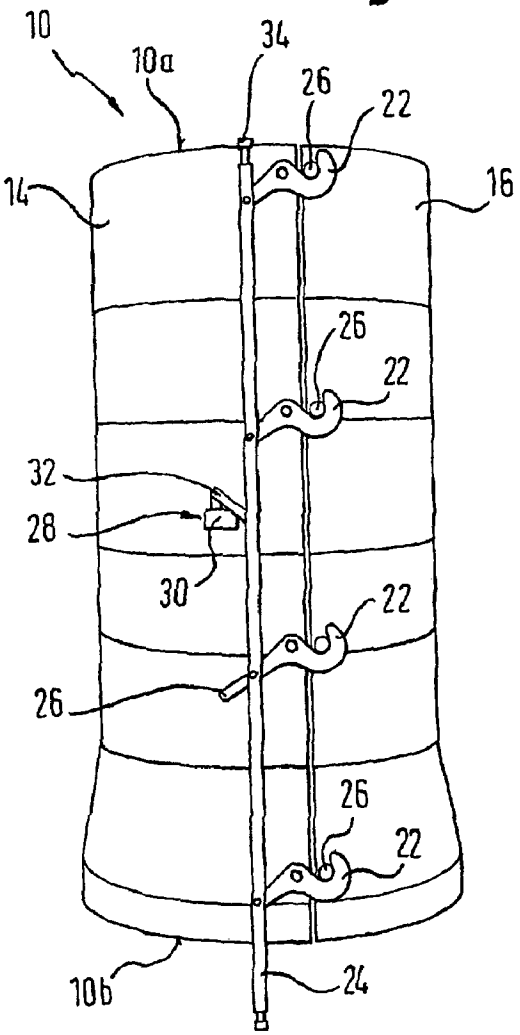
FIG. 2 is a front view of the mold casing of FIG. 1, the drive rod being in the ready-to-unlock position.
Figure 3:
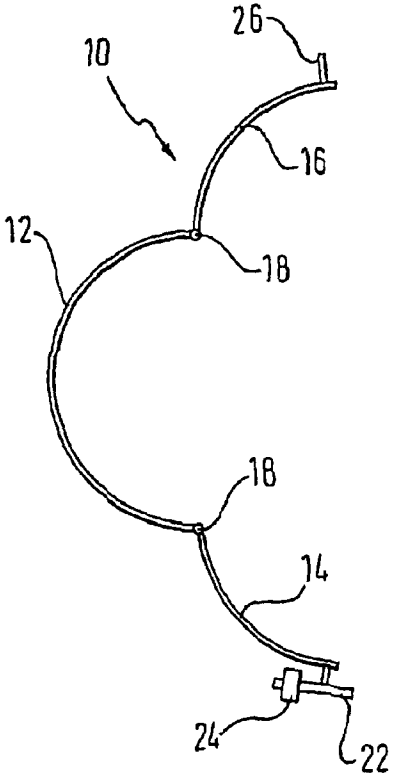
FIG. 3 is a topview of the mold casing of FIGS. 1 and 2 in its open position.

In the embodiment of the invention shown in FIGS. 1 through 3, the mold casing 10 comprises a semi-circular mold casing segment 12 and two quarter-circle mold casing segments 14, 16 which by means of hinges 18 articulate in foldable manner on the semi-circular segment 12. The mold casing segments 12, 14, 16 are externally fitted with circumferential ribs 20 which on one hand reinforce the mold casing 10 of the invention and on the other hand will implement affixation of omitted mechanical or electrical accessories.

Four pivoting latches 22 are mounted in the quarter-circle mold casing segment 14 shown at the left of FIGS. 1 and 2 near that longitudinal edge of the quarter-circle mold casing segment 14 which does not link up with the semi-circular mold casing segment 12. The four pivoting latches 22 are connected at their ends away from the quarter-circle mold casing segment 16 to a common drive rod 24. If the drive rod 24 is displaced from its position shown in FIG. 1 wherein it projects above the upper end face 10*a* of the mold casing 10, into the position shown in FIG. 2, then the four pivoting latches 22shall be pivoted counter-clockwise about their particular hinge points at the quarter-circle mold casing segment 14. In the process each pivoting latch 22 moves behind a peg 26 which is externally affixed at a height related to the particular pivoting latch 22 in the vicinity of the longitudinal edge of said segment 16 facing the circumferential edge of the quarter-circle mold casing segment 14. In this manner the two mold casing segments 14, 16 are connected to each other and the mold casing 10 is secured against opening accidentally.

When appropriately designing the tapered pivoting latches 22, the quarter-circle mold-casing segments 14, 16 moreover may be mutually tightened by adjusting the pivoting latches 22 out of their unlocked position shown in FIG. 1 into their locked position shown in FIG. 2. As a result there is improved sealing of the mold casing 10 when making the concrete pipe. In order to individually adjust the tension by means of which the pivoting latches 22 cooperate with the pegs 26 when in the locked position and thereby to reliably attain good sealing over the full length of the mold casing against undesired leakage of concrete, the pegs 26 may be configured to be eccentric relative to and rotatable about shafts affixing them to the mold casing 10. Obviously too the pegs may be rotated jointly with the affixation shafts.

As shown by FIGS. 1 and 2, the drive rod 24 of the illustrative embodiment above is longer than the mold casing 10, whereby it shall always project at least over one of its two end faces, namely beyond the upper and/or lower end face. As result the drive rod 24 shall always be in at least one of the two readiness positions. To prevent the drive rod 24 from assuming an undesired intermediate position wherein it would project beyond both end faces of the mold casing 10, and further to preclude the drive rod 24 from being displaced for instance downward illustratively on account of slight impacts when inserting the mold casing 10 into the production machine, the mold casing 10 includes a beyond-the-dead-point mechanism 28. This mechanism includes an affixation plate 30 affixed to the quarter-circle mold-casing segment 14 and also a spring 32 of which one end is affixed to the affixation plate 30 and the other end to the drive rod 24 in such manner that said spring shall always be relaxed in the ready-to-lock position shown in FIG. 1 and in the ready-to-unlock position shown in FIG. 2, whereas it shall be temporarily compressed while the drive rod 24 is displaced from one readiness position into the other. Consequently the spring 32 compresses the drive rod 24 depending on its instant position always into either of its readiness positions. In this process and assuming appropriate strength of the spring 32 and appropriate selection of its affixation points to the affixation plate 30 and to the drive rod 24, the beyond-the-dead-point mechanism 28 shall support said spring's inventive operation:

When the mold casing 10 with its pivoting latches 22 in the unlocked position as shown in FIG. 1 and consequently with the drive rod 24 in the corresponding ready-to-lock position is inserted into the production machine and said machine is started, then first the machine table shall be lowered onto the upper end face of the mold casing 10 and thereby it shall force downward the drive rod 24. A bolt 34 partly screwed into the drive rod 24 to match the length of the drive rod 24 to the dimensions of the production machine and in particular to those of the machine table. is provided at the upper end of the said rod 24. A corresponding length matching bolt 34 also may be used at the lower end of the drive rod 24.

Once the machine table has been entirely lowered onto the upper end face of the mold casing 10, then the mold casing 10 shall be in the position shown in FIG. 2 wherein the pivoting latches 22 engage the pegs 26 from behind. Accidentally unlocking the mold casing 10, that is accidental displacement of the pivot latches 22 out of their locked positions into the unlocked positions is precluded during the operation of the production machine in that the machine table resting on the top of the mold casing 10 inhibits the otherwise necessary upward motion of the drive rod 24.

After the mold casing 10 has been removed from the production machine, for instance using a fork lift, the beyond-the-dead-point mechanism 28 then prevents such accidental unlocking. In fact the spring 32 of the beyond-the-dead-point mechanism was moved during the descent of the drive rod 24 in the production machine beyond its dead point, that is beyond the point of maximum compression and accordingly it loads downward the drive rod 24 in the direction of its position shown in FIG. 2.

It is understood that to enable the described descent of the drive rod 24 into the production machine, the manufacturing table supporting the mold casing 10 in the production machine must exhibit a corresponding recess to receive the drive rod 24.

When the mold casing 10 in the position of FIG. 2 has been removed from the production machine and next is deposited by a fork lift, crane or the like on the ground, then the drive rod 24 which at its bottom is projecting and therefore is the first to rest on the ground shall be forced upward by the weight of the mold casing 10 and the finished concrete pipe inside it until the entire mold casing 10 stands by its lower end face on the ground. In the process the pivoting latches 22 are pivoted clockwise out of the locked position shown in FIG. 2 and into the unlocked position shown in FIG. 1 and thereby they disengage from the pegs 26. Now the mold casing 10 may be moved by merely by pivoting apart the two quarter-circle mold casing segments 14, 16 into the position shown in topview in FIG. 3 and in that position said casing may be removed in simple manner from the concrete pipe.

On account of said constrained upward motion of the drive rod due to depositing the mold casing 10 on the ground, the spring 32 again was displaced beyond its dead point, as a result of which it now loads the drive rod 24 upward in the direction of ready-to-lock position shown in FIG. 1.

In the event the displacement of the drive rod 24 should unexpectedly fail to operate, for instance because the mold casing 10 was deposited on too soft a ground into which the drive rod 24 when in its ready-to-lock position shown in FIG. 2 would sink instead of being constrained upward by it, the second pivot latch 22 from the bottom of the above illustrative embodiment shall be fitted with a grip portion 36. This grip portion 36 allows manually acting on the drive rod 24 and hence on the entire security device, in this particular instance for example by hammer blows on the grip portion 36. It is understood that where appropriate several and even all pivot latches 22 of the securing device may be fitted with such grip portions 36.

The mold casing of the invention can be rapidly and reliably unlocked and locked in the manner described above without thereby requiring special expenditures in personnel or time and without the need for a pneumatic, hydraulic or electric source of energy that would have to be hooked up to the mold casing 10. The mold casing 10 of the present invention therefore allows more economical manufacture and in particular mass production of concrete pipes, especially on account of being directly applicable using extant production machines. Nor is the mold casing 10 of the invention restricted to the illustratively above described embodiment. Obviously several drive rods 24 may be externally mounted on the mold casing 10 and be associated with independent latching elements and, during the descent of the machine table on the mold casing 10 and after depositing the mold casing 10 on the ground, shall be actuated substantially simultaneously or sequentially. In principle, moreover, production machines might be used wherein the machine table is moved from below or from the side toward the mold casing 10. In that case the drive rod 24 would project when in its ready-to-lock position beyond the lower or beyond a lateral end face and be forced upward or resp. laterally away by the approaching machine table. To unlock the mold casing 10, it might then be rotated by 180° resp. 90° and next be deposited on the ground, or the drive rod 24 when in its ready-to-unlock position projecting above the upper end face might be forced back by an element moving in the appropriate direction in the same or another machine.

What is claimed is:

1. A mold casing (10) for manufacturing molded bodies, where the mold casing (10) may be moved into a closed manufacturing position to prepare for the manufacture of the molded body and may be opened when in said position of manufacture to release the manufactured molded bodies, comprising:

a securing device fitted onto two mutually displaceable mold-casing segments (14, 16) closing or opening the mold casing and by means of which the mold casing (10) may be secured into position of manufacture, where the securing device comprises at least one latch (22) mounted on one of the mold-casing segments (14, 16) and at least one latch mating-element (26) which is mounted on the particular other mold-casing segment (16), where the at least one latch (22) is adjustable by means of a drive unit (24) between a locked position corresponding to one of the manufacturing positions of the mold casing (10) in which it is in locking engagement with an associated latch mating-element (26) and an unlocked position in which the locking engagement has been eliminated, wherein the drive unit (24) is movable between a ready-to-unlock position corresponding to the locked position of the latch (22) and a ready-to-lock position corresponding to the unlocked position due to relative motions entailed by manufacturing procedures of the mold casing on one hand and its manufacturing environment on the other;

wherein the drive unit (24) when in its ready-to-unlock position projects beyond a first end face (10*b*) of the mold casing (10) and when in its ready-to-lock position projects beyond a second end face (10*a*) of the mold casing (10).

2. Mold casing as claimed in claim 1, characterized in that during operation of the mold casing (10) the first end face (10*b*) shall be the lower end face and the second end face (10*b*) shall be the upper end face.

3. A mold casing (10) for manufacturing molded bodies, where the mold casing (10) may be moved into a closed manufacturing position to prepare for the manufacture of the molded body and may be opened when in said position of manufacture to release the manufactured molded bodies, comprising:

a securing device fitted onto two mutually displaceable mold-casing segments (14, 16) closing or opening the mold casing and by means of which the mold casing (10) may be secured into position of manufacture, where the securing device comprises at least one latch (22) mounted on one of the mold-casing segments (14, 16) and at least one latch mating-element (26) which is mounted on the particular other mold-casing segment (16), where the at least one latch (22) is adjustable by means of a drive unit (24) between a locked position corresponding to one of the manufacturing positions of the mold casing (10) in which it is in locking engagement with an associated latch mating-element (26) and an unlocked position in which the locking engagement has been eliminated, wherein the drive unit (24) is movable between a ready-to-unlock position corresponding to the locked position of the latch (22) and a ready-to-lock position corresponding to the unlocked position due to relative motions entailed by manufacturing procedures of the mold casing on one hand and its manufacturing environment on the other;

wherein the drive unit (24) comprises a drive rod (24) which is displaceable in the longitudinal direction of the mold casing (10).

4. Mold casing as claimed in claim 3, characterized in that the drive rod (24) is longer than the mold casing (10).

5. Mold casing as claimed in claim 3, characterized in that the drive bar (24) is fitted at least at one of its ends with a longitudinally adjustable length-adjusting element (34).

6. A mold casing (10) for manufacturing molded bodies, where the mold casing (10) may be moved into a closed manufacturing position to prepare for the manufacture of the molded body and may be opened when in said position of manufacture to release the manufactured molded bodies, comprising:

a securing device fitted onto two mutually displaceable mold-casing segments (14, 16) closing or opening the mold casing and by means of which the mold casing (10) may be secured into position of manufacture, where the securing device comprises at least one latch (22) mounted on one of the mold-casing segments (14, 16) and at least one latch mating-element (26) which is mounted on the particular other mold-casing segment (16), where the at least one latch (22) is adjustable by means of a drive unit (24) between a locked position corresponding to one of the manufacturing positions of the mold casing (10) in which it is in locking engagement with an associated latch mating-element (26) and an unlocked position in which the locking engagement has been eliminated, wherein the drive unit (24) is movable between a ready-to-unlock position corresponding to the locked position of the latch (22) and a ready-to-lock position corresponding to the unlocked position due to relative motions entailed by manufacturing procedures of the mold casing on one hand and its manufacturing environment on the other;

wherein a beyond-the- dead-point mechanism (28) is used to tighten the drive unit (24) as a function of its position in the direction of one of the two positions of readiness.

7. Mold casing as claimed in claim 1, characterized in that the minimum of one latch (22) consists of a pivoting latch (22) pivoting upon actuation of the drive unit (24) and in that the associated latch mating-element (26) consists of a peg (26) which is engaged from the rear by the pivoting latch (22) during said pivoting motion.

8. Mold casing as claimed in claim 1, characterized in that the latch (22) and/or the latch mating-element (26) is fitted with tapered surfaces.

9. Mold casing as claimed in claim 1, characterized in that the latch (22) and/or the latch mating-element (26) is fitted with a mechanism to adjust the tightening between the latch (22) and the latch-mating element (26) in the locked position.

10. Mold casing as claimed in claim 7, and where called for in claim 8, characterized in that the peg (26) is eccentrically affixed to an affixation shaft mounted on the mold casing (10).

11. Mold casing as claimed in claim 1, characterized in that at least one latch (22) of the securing-device is fitted with a grip portion (36) used for manual actuation.

12. Mold casing as claimed in claim 1, characterized in that several latches (22), preferably all latches (22) are driven by a common drive unit (24).

13. Mold casing as claimed in claim 1, characterized in that it comprises at least two mutually pivotably linked mold-casing segments (12, 14, 16).

14. Mold casing as claimed in claim 13, characterized in that it consists of three mold-casing segments (12, 14, 16), two quarter-circle mold-casing segments (14, 16) being pivotably linked to a semi-circular mold-casing segment (12) and being mutually connectable by the securing device.

15. Mold casing as claimed in claim 1, characterized in that it comprises an essentially continuous circumferential mold wall which is merely interrupted by a slot connecting the two circumferential end faces of the mold casing.

16. Mold casing as claimed in claim 1, characterized in that, when in its ready-to-unlock position, the drive unit (24) is mounted in a region between the first longitudinal end surface (10*b*) and the second longitudinal end face (10*a*), however proximate of the first end face (10*b*), and when in its ready-to lock position, is mounted in a region between the first end face (10*b*) and the second end face (10*a*), however proximate of the second end face (10*a*).

17. Mold casing as claimed in claim 5, wherein said longitudinally adjustable length-adjusting element (34) comprises a bolt which is at least partly screwed into or onto the drive rod.

* * * * *